US007806299B2

(12) United States Patent
Wauters et al.

(10) Patent No.: US 7,806,299 B2
(45) Date of Patent: Oct. 5, 2010

(54) ALCOHOL BEVERAGE DISPENSING APPARATUS

(75) Inventors: Albert Wauters, Destelbergen (BE); Ian Anderson, Burwell (GB)

(73) Assignee: Anheuser-Busch InBev S.A., Brussels (BE)

( * ) Notice: Subject to any disclaimer, the term of this patent is extended or adjusted under 35 U.S.C. 154(b) by 1230 days.

(21) Appl. No.: 10/536,971

(22) PCT Filed: Nov. 26, 2003

(86) PCT No.: PCT/IB03/05411

§ 371 (c)(1),
(2), (4) Date: Feb. 1, 2006

(87) PCT Pub. No.: WO2004/050535

PCT Pub. Date: Jun. 17, 2004

(65) Prior Publication Data

US 2006/0151528 A1 Jul. 13, 2006

(30) Foreign Application Priority Data

Nov. 29, 2002 (GB) ..... 0227941.2

(51) Int. Cl.
*B67D 7/74* (2010.01)

(52) U.S. Cl. ..... 222/129.1; 222/146.6; 222/183; 222/386.5; 222/389; 222/400.8

(58) Field of Classification Search ..... 222/95, 222/105, 146.6, 183, 386.5, 389, 401, 399, 222/394, 396, 400.8, 129.1
See application file for complete search history.

(56) References Cited

U.S. PATENT DOCUMENTS 4,031,913 A 6/1977 Apellaniz ..... 137/170.1
4,610,888 A 9/1986 Teng et al.

(Continued)

FOREIGN PATENT DOCUMENTS

DE 2801668 A1 7/1978

(Continued)

OTHER PUBLICATIONS

Pazhi, D.G. and Galustov, V.V., "Basics of the Technology of Liquid Spraying" (Moscow, Khimiya, 1984, pp. 47-51).

*Primary Examiner*—Frederick C. Nicolas
(74) *Attorney, Agent, or Firm*—Levy & Grandinetti

(57) ABSTRACT

The present invention relates to a conduit for conducting gasified liquid, which has a flow restrictor arranged in in-line relation therewith. The restrictor itself comprises an at least one aperture (although two or more can be used in series), with each such being adapted to pass the gasified liquid flowing through the conduit and across a pressure drop from a higher-pressure upstream side of the aperture to a lower-pressure downstream side of the aperture. The aperture is operable to moderate the rate of change in pressure over a transitional pressure drop to mitigate the formation of localized pressures below a critical pressure at which off-gassing from the carbonated liquid results in substantial foam formation. The conduit may take the form of a dispensing tube for use in dispensing an alcoholic beverage from a keg, the tube having a flexible wall deformable under the influence of a restricting actuator to control the partial collapse of the wall and thereby form the restrictor. The tube or flow diameter downstream of the restrictor only gradually or slowly increases.

56 Claims, 8 Drawing Sheets

U.S. PATENT DOCUMENTS 4,651,898 A 3/1987 Bell ..... 222/129
5,251,787 A 10/1993 Simson

FOREIGN PATENT DOCUMENTS

DE 19847465 A1 4/2000
EP 1243548 A2 9/2002
GB 790 140 2/1958
GB 1207155 9/1970
NL 1019526 1/2002
WO 91/00240 1/1991
WO 98/03812 1/1998
WO 00/03944 1/2000

ALCOHOL BEVERAGE DISPENSING APPARATUS

FIELD OF THE INVENTION

The present invention relates to an alcohol beverage dispensing apparatus and in particular, relates to a beer line for dispensing beer, usually in association with tap adapter for mounting with a container or keg.

BACKGROUND OF THE INVENTION

It is known to contain alcohol, such as wine in bags contained in a cardboard type container where the wine feeds by gravity through a shut off tap mounted outside the container. Further, it is known to fill a bag with beer in a keg. In the case of a beer keg, pressure is applied to the bag to dispense the beer from the bag and out of the keg. Further, the bag is inserted into the keg container prior to the beer being filled into the bag through a valve assembly.

However, there is a need for the user to be able to control the dispensing of the beer from the keg out through a tap connected to the valve assembly particularly in special circumstances where the beer is to be dispensed directly from the keg. These special circumstances occur when the keg is utilized at an outdoor activity or where a consumer does not desire to purchase a home beer dispensing system and still desires to make use of beer stored in a keg.

SUMMARY OF THE INVENTION

It is an object of the present invention to provide a conduit for fluidized liquids that helps to reduce foam generation during flow through the conduit. The present invention finds application in relation to conduits for conducting carbonated liquids; or, a nitrogenated liquids; or a combination carbonated and nitrogenated liquids. Although a variety of uses for such conduit can be envisaged, the application as a liquid dispense conduit is particularly relevant with regard to avoiding excessive foam formation—and examples of this arise in beverage dispensing, especially in the case of beer.

In another embodiment, the invention provides a tap adapter for dispensing a beverage from a container whilst controlling the generation of excessive foaming.

Generally speaking, the present invention relates to a conduit for conducting gasified liquid, which conduit has a flow restrictor arranged in in-line relation therewith. Moreover, it is important, that the flow diameter must be only gradually increased downstream of the restrictor.

The restrictor itself comprises an at least one aperture (although two or more can be used in series), each such being adapted to pass the gasified liquid flowing through the conduit and across a pressure drop from a higher-pressure upstream side of the aperture to a lower-pressure downstream side of the aperture.

The aperture is operable to moderate the rate of change in pressure over a transitional pressure drop to mitigate the formation of localized pressures below a critical pressure at which off-gassing from the carbonated liquid results in substantial foam formation.

In some applications it is actually preferable to employ a plurality of apertures arranged in series along the path of the gasified liquid flow. In this case, sequential downstream pressure drops are produced between successive pairs of apertures to respective intermediate pressures that are lower than the pressure upstream of the first aperture in the series and higher than the pressure downstream of the last aperture in the series.

This arrangement improves the overall effect of mitigating against foam formation. At least two such apertures, and preferably static apertures are preferred.

In a particularly preferred embodiment, the conduit contains at least one aperture which is venturi-shaped. It is desirable, particularly in the case of beer dispensing operations, that such a venturi has a back angle of less than 24 degrees, preferably about 20 degrees or less, and even more preferably, about 15 degrees or less.

The conduit is preferably formed as a formed tube having an integral stricture arranged along the length thereof, to provide for the requisite aperture and, in preferred embodiments, to form the venturi shaped aperture in particular. Although the tubing can be preformed (cast or extruded for example) to provide for the requisite aperture, it is also possible to form the tube in situ. For example, where the conduit is a pliable tube, which is compressible in situ to form an aperture by the application of external force—the application of external force such as a clamping action along a tube-contacting face of a cam or wedge shaped body, can be used to produce a correspondingly shaped aperture within said tube and hold the tube in position relative the rest of a dispensing apparatus. Again, the internal diameter of the tube post the stricture increases only gradually, for example, resulting in the interior walls of the tube having an effective back angle of less than 24 degrees.

Preferably the inlet end and the outlet end of the conduit are substantially the same internal diameter—although variations on this are possible if desired. In any case, in a beer dispense application, it is desirable that the inlet end be adapted to engage a beer keg valve; and, that the outlet end be a nozzle through which the beer is dispensed into a beverage container. Such a conduit—"dispensing tube"—is inexpensive and easily installed. Moreover, it is particularly well suited to use if comprised of a flexible tubing that can be compressed by an external clamping valve to constrict flow between substantially free flowing dispense and shut-off conditions.

BRIEF DESCRIPTION OF THE DRAWINGS

For a better understanding of the nature and objects of the present invention reference may be had to the accompanying diagrammatic drawings in which.

DETAILED DESCRIPTION OF THE INVENTION

Figure 2:
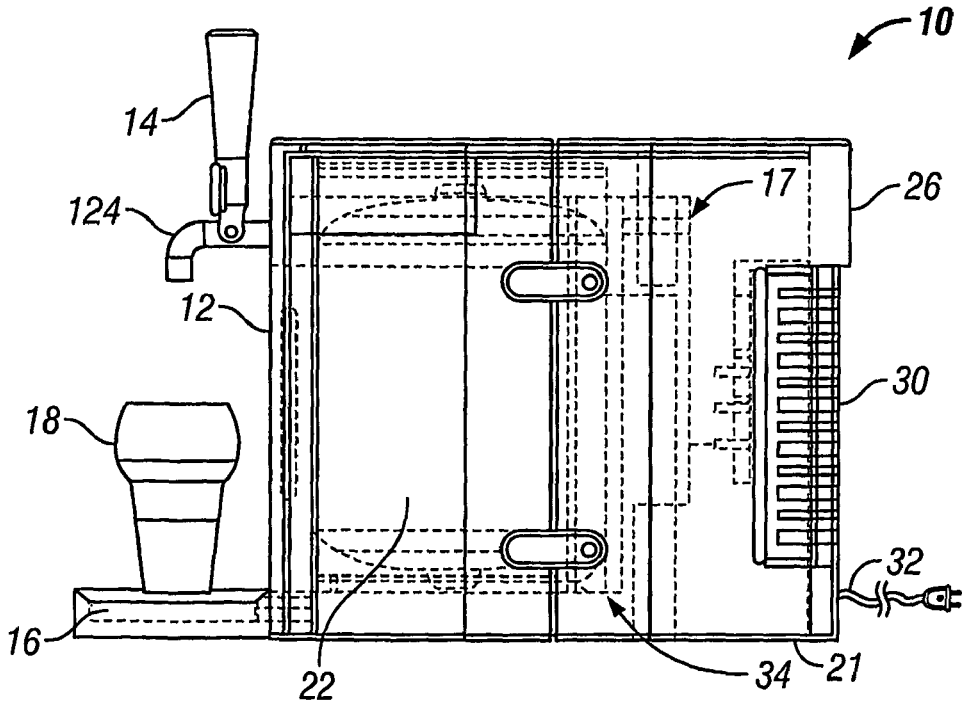
FIG. 2 is a side elevation view of the home beer dispensing apparatus.

In a preferred application of the present invention, a venturi equipped conduit is employed as an insertable cartridge in a beer tap aperture—which is useful in turn, in dispensing beer from a keg in either free-standing applications, or from within a housing as for example in the case of a beer cooling appliance or the like, such as is described in FIG. 2.

Figure 1:
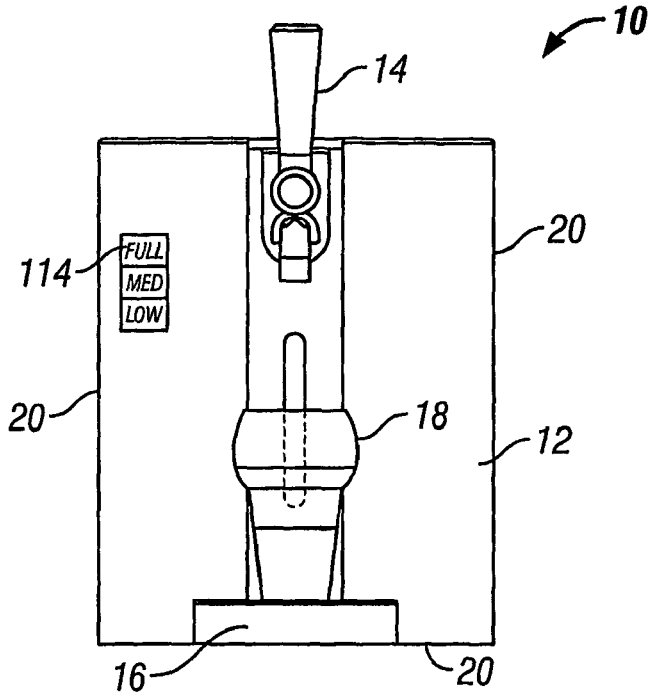
FIG. 1 is a front elevation view of a home beer dispensing apparatus in accordance with the present invention.

Referring to FIGS. 1 and 2 there is shown a home beer dispensing apparatus, appliance or unit 10. The dispensing apparatus 10 is primarily intended for use in domestic kitchens but may also be used in utility rooms, garages, domestic bars, caravans etc. While the preferred embodiment relates to dispensing beer, alternatively carbonated solutions or other alcohol beverages may be dispensed by apparatus 10.

The home beer dispensing apparatus 10 has a front wall 12 and a dispensing tap 14 protruding forward of the front wall 12. A drip tray 16 also protrudes forward of the front wall 12 and is adapted to support an open glass container 18 below the dispensing tap 14. The home beer dispensing apparatus 10 further has a base 21 adapted to rest on a counter top. The front wall 12 is an extension of two pivoting side walls 20 which may be moved between closed and open positions to allow the keg 22 (see FIG. 2 in broken lines) to be inserted into the housing of the home beer dispensing apparatus 10.

The housing 17 of the home beer dispensing apparatus 10 further includes a top wall 24 and a rear wall 26. The rear wall 26 has a grill 30 that permits for air circulation within the home beer dispensing apparatus 10. An electrical cord 32 extends through the rear wall 26 of the apparatus 10 to provide a connection into a main electrical supply to supply electrical power to the electrical components housed within the unit 10. Alternatively, a 12 Volt DC supply input may be used.

The dispensing apparatus 10 has a cooling system 34 located behind and below keg 22 that is adapted to cool beer in keg 22 when keg 22 is placed into dispensing apparatus 10.

Figure 3:
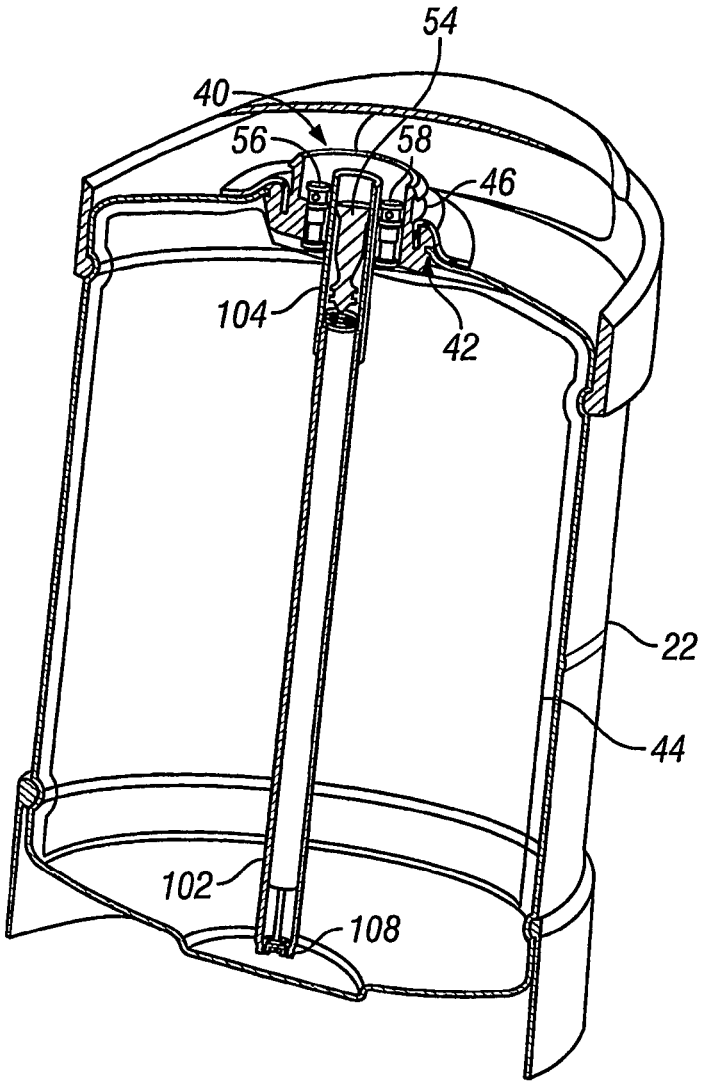
FIG. 3 is broken away perspective view of the keg showing the valve and spear assembly mounted within the keg.
Figure 5:
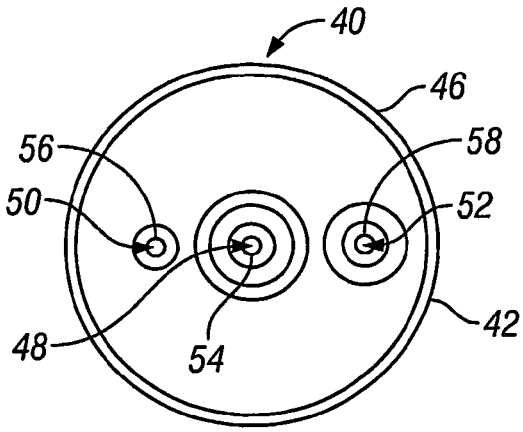
FIG. 5 is a plan view of the valve body of the valve assembly.
Figure 4:
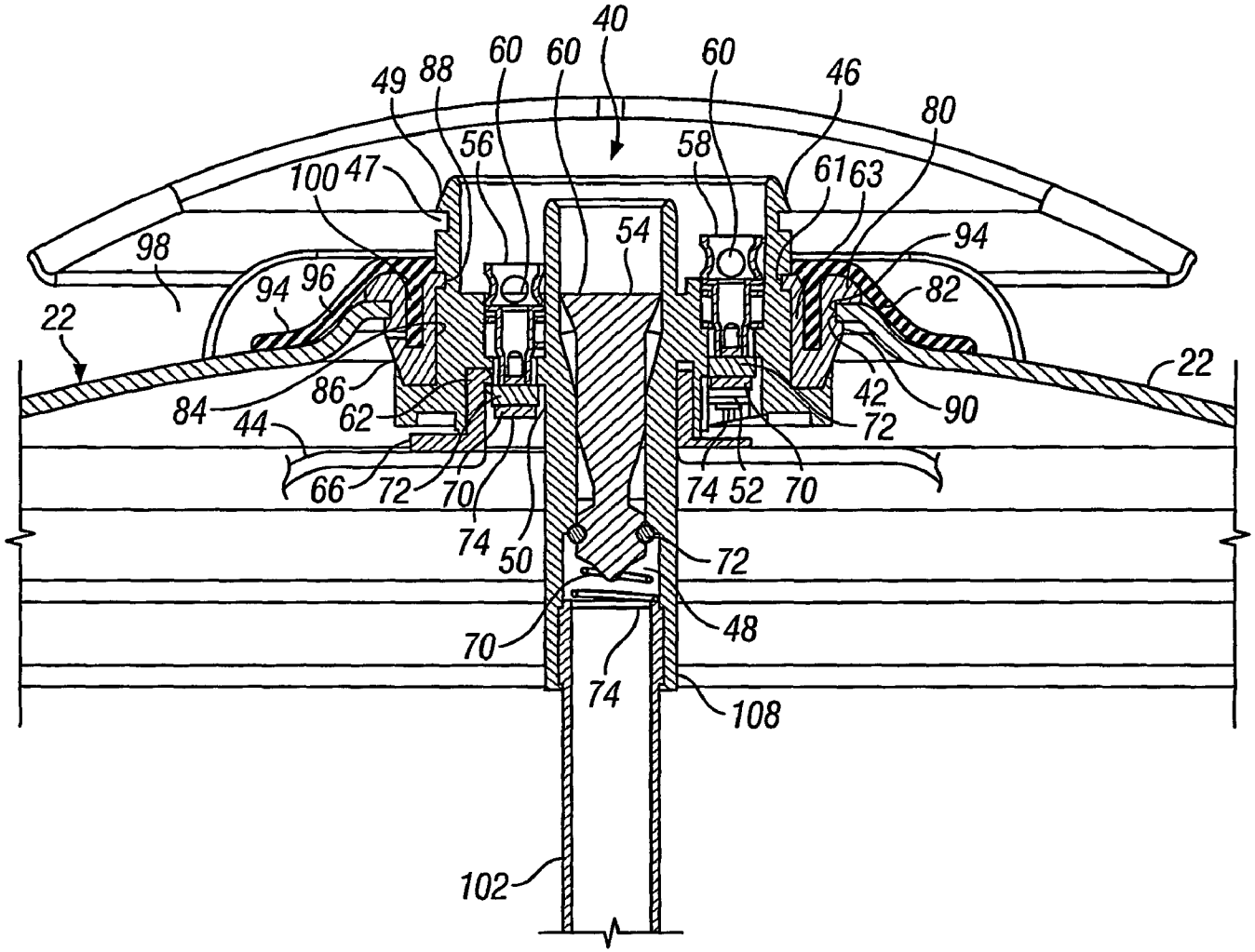
FIG. 4 is a sectional side view of the valve and spear assembly as shown in FIG. 3.

Referring to FIGS. 3 through 5, the preferred valve assembly 40 and spear 102 are shown. The valve assembly 40 is adapted to fit into a raised collar aperture 42 of keg 22. The valve assembly 40 has an annular shaped body 46 that is secured in the aperture 42. The valve body 46 has an annular groove 47 and flange 49 that is adapted to extend above the keg 22 for mating with a tap dispensing adapter 38 (FIG. 4) connected to tap 14.

Figure 8:
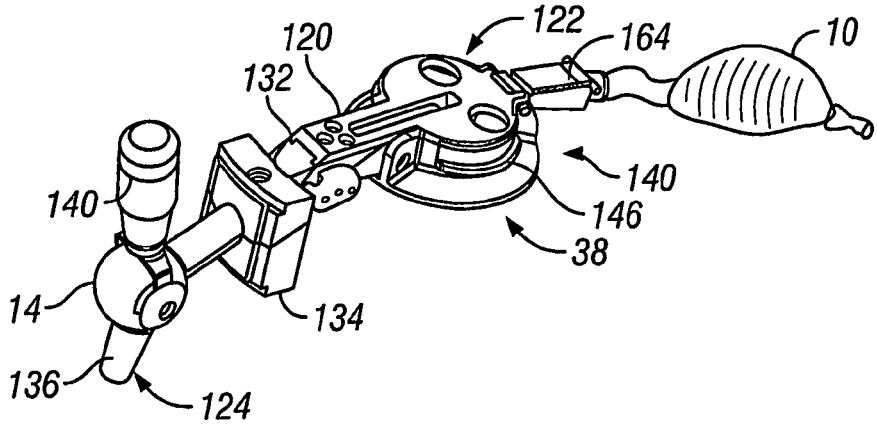
FIGS. 8 and 9 are perspective views of the tap adapter respectively showing the hollow arm in closed and open positions.

The valve body 46 has a first passageway 48, a second passageway 50, and a third passageway 52 spaced apart from each other and extending through the valve body 46. As best seen in FIG. 8, the first passageway 48 is centrally disposed or located within the valve body 46 and the second and third passageways 50, and 52 are spaced radially of the first central passageway 48.

The valve assembly includes a first valve 54, a second valve 56 and a third valve 58. The first valve 54 is seated in the first passageway 48 for controlling the flow of the beverage or beer through the first passageway 48 into and out of the bag 44.

The second valve 56 is seated in the second passageway 50 for controlling the flow of gas such as carbon dioxide through the second passageway 50 into and out of the bag.

The third valve 58 is seated in the third passageway 52 and controls the flow of gas through the third passageway 52 into and out of the keg 22 exterior to the bag 44.

Each valve, 54, 56, and 58 has a valve actuator or stem 60 that effectively opens and closes the valve. The valve stem 60 extends away from the valve body 46 by a different predetermined distance for each of valves 54, 56 and 58. Each of the valves 54, 56 and 58 further include a valve head 70 connected to the valve stem 68. The valve head 70 carries an O-ring 72 which is adapted to seal the valve head within the respective passageway. A spring 74 urges the valve head 70 into sealing engagement with its corresponding passageway. The valve stems 68 are accessible from outside the keg 22 for moving each valve head 70 into an open and closed position to respectively enable and inhibit fluid flow through passageways 48, 50 and 52.

The valve body 46 has an annular recessed groove 62 recessed in an inner wall 64 of the valve body 46. The inner wall 64 is positioned within the keg 22. The recessed groove 62 is adapted for receiving the neck 66 of bag 44 in press fit relation therewith. The annular recessed groove 62 has a diameter that surrounds the first and second passageways 48 and 50. The third passageway 52 is located outside of the diameter of the recessed groove 62 and as a result, the third passageway 52 is located outside of the bag 44.

The keg 22 has a collar flange 82 which defines the raised collar aperture 42, the valve body 46 has an outer peripheral wall 63 with a recessed groove 61 extending around the outer wall 63. An intermediate ring or bung 80 is adapted to seat the valve body 46 within the raised collar aperture 42. The intermediate ring 80 has inner and outer walls 84, 86. The inner wall 84 has flange 88 extending inwardly thereof that is adapted to fit into the recessed groove 61 of the outer wall 63 of the valve body 46. The outer wall 86 of the intermediate ring 80 has a resilient barb 90 and a locking flange 92 spaced from the barb 90 so as to define an outer locating groove 94 into which the collar flange 82 of the keg 22 is held. The barb 90 is adapted to pass through the aperture 42 and spring back into locking engagement with the collar flange 82 so as to lock the valve assembly 40 in place. Special tools are required to remove the valve assembly 40 and the intermediate ring 80 from the collar flange 82 of the keg 22 once the keg 22 is returned to the brewery for refilling.

In order to ensure that the contents of the keg 22 have not been tampered with, the keg 22 has an anti-tamper ring 96 that overlays the intermediate ring 80, a portion of the keg 22 and a portion of the valve body 46. The intermediate ring 80 has an aperture 98 that passes completely through the intermediate ring 80 to provide a vent passageway. The anti-tamper ring 96 has a flange part 100 that is inserted into the vent aperture 98 of the intermediate ring 80. In the event the anti-tamper ring 96 is removed from the keg 22, vent aperture 98 is open and the contents or any pressure within the keg 22 is released. Further, as a pressure relief feature, the anti-tamper ring 96 is designed to release from aperture 98 when pressure in keg 22 exceeds a predetermined valve to vent pressurized air through aperture 98.

Referring to FIGS. 6 to 9, the tap adapter 38 of the present invention is shown in more detail. The tap adapter 38 is mounted to the valve assembly 40 in fluid flow communication with the first valve 54. This attachment is a snap action sealed attachment on inner and outer walls of valve flange 49.

The dispenser adapter 38 has a hollow arm 120 that has a first end portion 122 adjacent the valve assembly 40 and a second end portion 124 which is remote therefrom. The first end portion 122 is connected to the first valve 54 so as to open the valve 54. This connection is made when the adapter is snap fitted downwardly onto the valve neck flange 49. The hollow arm 120 extends from the valve assembly 40 out through the housing 17 to a position where the remote end portion 124 of the hollow arm 120 is outside of the housing 17.

Figure 7:
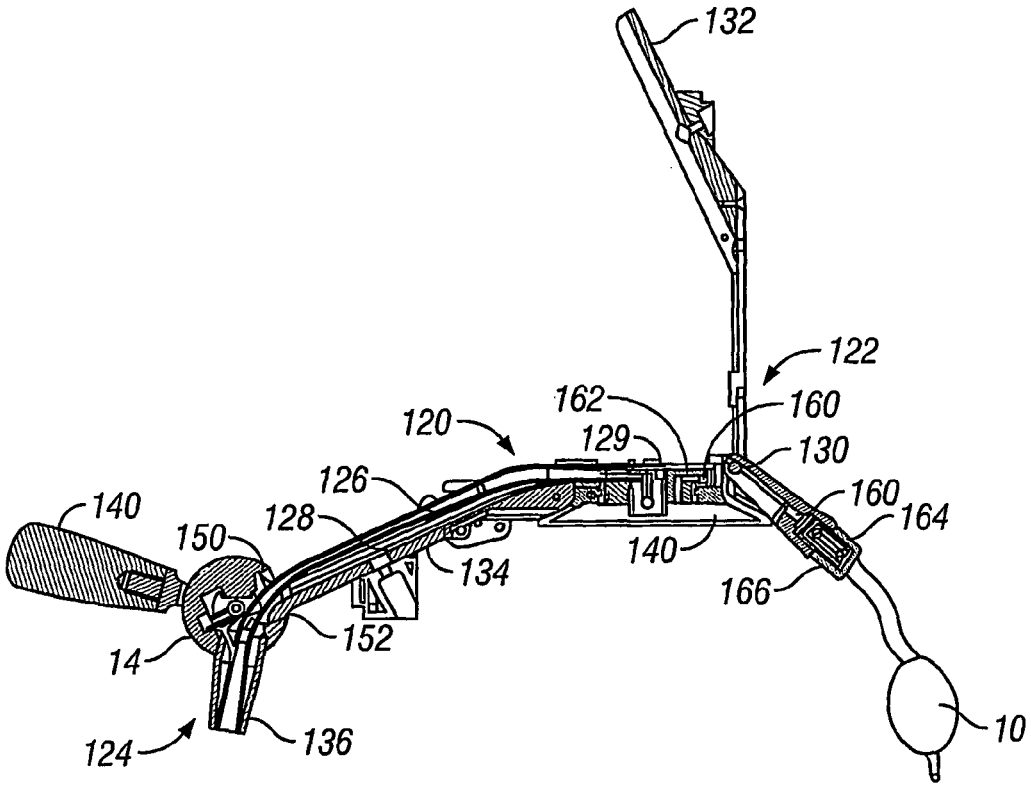
FIG. 7 is a side sectional view of the tap adapter of FIG. 6 showing the tap pivoted open.
Figure 9:
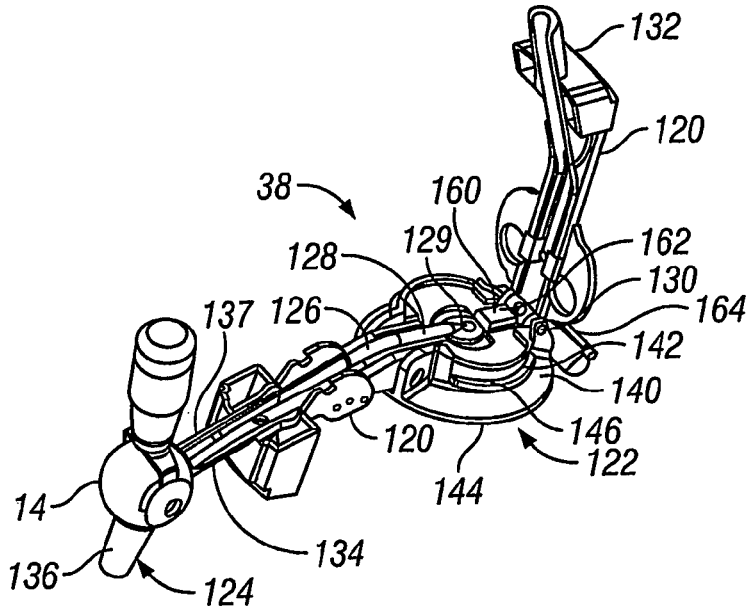

As better shown in FIGS. 7 and 9, the hollow arm 120 is separable by a hinge point 130. The arm 120 is separable into an upper arm portion 132 and a lower arm portion 134. As shown in FIG. 9, lower arm portion 132 carries the tap 14 integral therewith. The lower arm portion 134 comprises a half hollowed out passageway 137 (see FIG. 9).

The immediate following describes in detail a first embodiment wherein the foam controlling element takes the form of a cartridge located in the hollow arm 120 of the adaptor 38. Inserted into this lower arm portion 134 is a tubular cartridge 126 that has a tube 128 that interconnects the tap 14 with the first valve 54 so that the beverage may flow through the tube 128 and out the tap end 136. The cartridge 126 is in effect a frame like member which is adapted to be snap fitted into place with the lower arm portion 134. The cartridge 126 also carries the tube 128 therethrough for connection into the first end portion 122 of the hollow arm 120 so that when the cartridge is inserted into the hollow arm 120, and the hollow arm is subsequently mounted onto the valve assembly 40, one end 129 of the tube 128 sealingly engages passageway 48 and opens valve 54 so that beverage may be dispensed through valve 54 and into the tube 128. The upper arm portion 132 as shown in FIG. 9 may then be snapped back into place relative to the lower arm portion 132.

The adapter 38 is provided with a base portion 140 for supporting the hollow arm 120. The base portion 140 has a neck or supporting ring 142 that is adapted to surround and releasably engage the valve neck flange 49. The base portion 140 further includes an annular flange portion 144 which provides an inverse shape of a saucer that is adapted to abut the top surface of the keg 22 and to be supported thereon.

The base portion 140 has locking spring members 146 (see FIG. 9) that engage the valve neck groove 47 and are movable to release the adapter 38 from the valve assembly 40.

Figure 6:
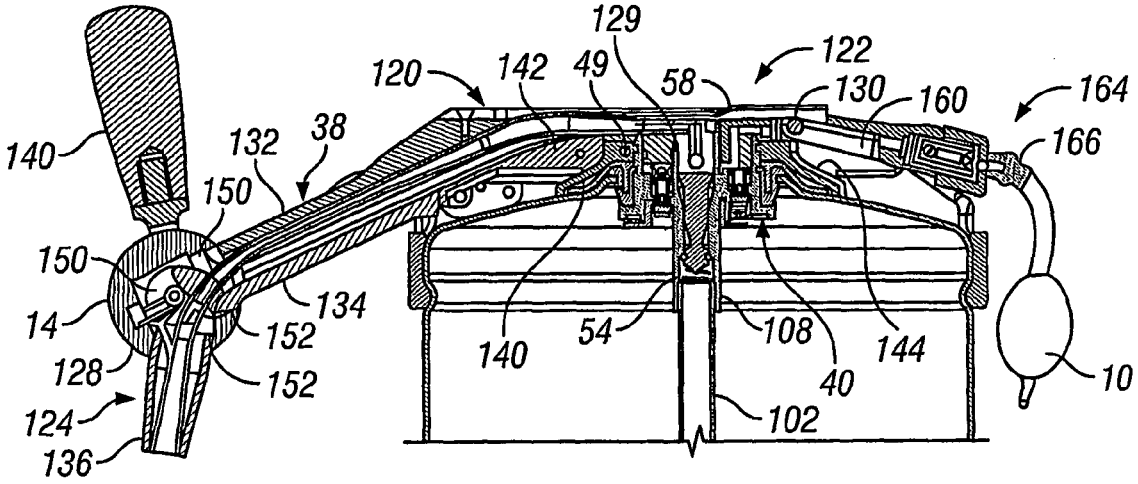
FIG. 6 is a sectional side view of the tap adapter mounted to the keg.

Tap 14 is connected to the remote end 124 of the hollow arm 120 and in particular the lower arm portion 134. The tap is operable between a closed position to shut off the flow of beverage through the hollow arm as shown in FIG. 6 and an open position permitting beverage to flow through the hollow arm and out the tap 14 as shown in FIG. 9. The tap 14 also forms an integral part of the hollow arm 120 and in particular the lower portion 134. The tap 14 has a handle 140 that is pivotally connected to a cam member 150 so as to rotate cam member 150 into pinching engagement against tube 128 as indicated at pinching point 152. The handle will be normally biased in this position and may be drawn forward to release cam member 150 from the tube 128 and thereby open the tube at point 152 and permit beverage to be dispensed along the tube 128 contained within the hollow arm 120 from the valve assembly 40.

As shown in FIGS. 6 to 9, the dispensing adapter 38 includes an air line passageway 160 adapted to be connected to a second air valve 58 in fluid flow communication. The air line passageway 160 has a first end or cap member 162 that connects to and opens the second valve 58 when the adapter 38 is snap fitted onto the valve system 40. The air line passageway 160 has a second end portion 164 having a one way air valve 166 that is normally shut and that is opened when connected, for example, to a manually operable bellows air pump 10. Manual squeezing of pump 10 supplies air under pressure to the inside of keg 22 against bag 44. The air line passageway 160 is an integral part of the adapter 38.

The adapter 38 of the present invention has many advantages. In particular, the adapter 38 can be sold as a separate part to a consumer and the cartridge 126 may be sold as a replacement cartridge with each keg 22 refill for insertion into adapter 38 so as to provide a sanitary dispensing medium for the beverage. The cartridge 126 is inserted into the adapter 38 and the adapter 38 is moved into its closed position and snapped onto the keg neck 47. Because the adapter carries the tap 14 which is in a closed position, the snapping of adapter 38 onto the valve assembly 40 of the keg 22 in sealing relation therewith opens valve 54 and provides for a simple and reliable connection that does not result in any loss of beverage. At this time, the air supply line 160 is connected to the air valve 58 of the valve assembly 40. The keg 22 is ready for use as a portable free standing unit.

The adapter 38 is now ready to dispense beverage by drawing handle 148 forward releasing the cam 150 from pinching the tube 128 allowing the beverage to flow therethrough out through valve 54. It should be understood that pressure is applied against the bag 44 FIGS. 3 and 4) in through the air line passageway 160 and through the valve 58 of the valve assembly 40 by manual operation of pump 10.

Figure 10:
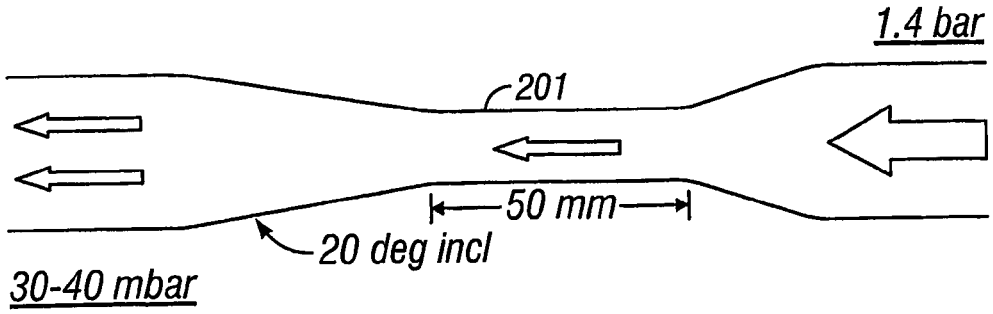
FIG. 10 is a schematic cross-section of a venturi arrangement according to the present invention, and depicting operating conditions and dimensions particularly suited to beer dispensing applications.

Referring now to FIG. 10 of the drawings, there is illustrated a schematic longitudinal cross-section through a section of conduit 200 according to the present invention, in which the venturi 201 structure is illustrated. As dimensioned, and for the operating conditions set out, the arrangement is particularly suited to home beer dispense applications.

Figure 11:
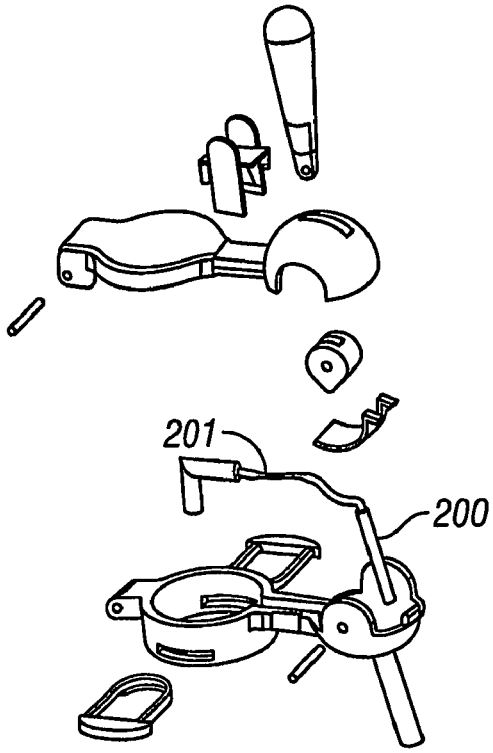
FIG. 11 is an exploded view of a tap adapter showing the insertable tubular cartridge comprising a venturi equipped conduit of the present invention.
Figure 12:
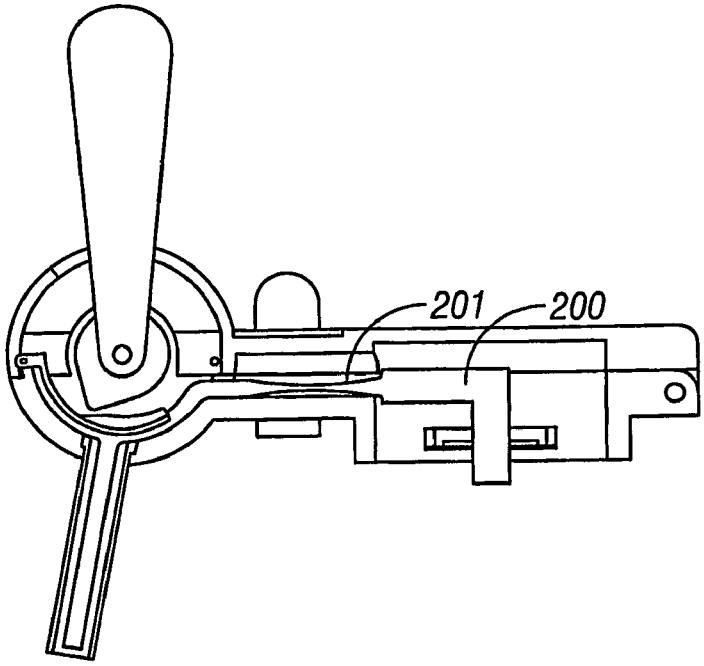
FIG. 12 is a side section view of the tap adapter of FIG. 11.

FIGS. 11 and 12 illustrate the conduit 200 and the venturi 201, in relation to a beer dispense tap apparatus. Although not shown, FIG. 12 makes it clear generally how a cam shaped clamp could be employed relative to a flexible conduit when clamped into the tap apparatus, to form the an aperture shape, in situ, this aspect of the invention being described in detail below.

Referring to the drawings in general, and referring to an especially preferred embodiment of the present invention, the beer line possesses a venturi or a portion of tube that: tapers down gradually from around 8 mm to 1.5 mm; continues at 1.5 mm diameter for 50 mm or 60 mm; and then expands outwards gradually back (through a back angle) to around 8 mm. The length and diameter of the restricted portion combine to determine both the delivered flow rate of beer and the pressure drop across the restrictor. In the preferred case, this should be around 1 bar—the internal pressure of the keg—to avoid beer foaming. The diameter of the restrictor is also an influential factor—too large a diameter and the dispense flow rate is too high and there is little pressure drop, too narrow a diameter and the dispense flow rate is very slow. In forming the venturi, the tapered convergent and divergent sections are adapted to ensure that vortices are not created in the beer flow, which would lead to out localized low pressure regions and related out-gassing and foaming.

In a preferred form of venturi system to reduce pressure and control flow, an 8 mm standard diameter tube is used, having a 1.5 mm diameter through the integrally formed venturi, which extends for a length of over 50 mm, and expands at a 20° inclusive angle (or by 10 degrees on both side) back to a final conduit diameter of 8 mm. This gradual return to the original tubing diameter reduces risk of foaming for the beer transiting this conduit (at about 2 liters/min.). Note that the same angles can be used on the upstream side of the venturi in reducing from the nominal tube diameter to the narrow venturi tube diameter. Under the conditions described herein and in the drawings, all sections of the conduit up stream of venturi including up to the keg valve, are above foaming pressure. Minimising distance after venturi to the dispense spout is also helpful.

Beer dispensing in this case involves a continuous dispense rate of between 1.5 liters/minute and 2.0 liters/minute without "excessive" foaming for the conditions described below. Air pressure maintained between 1.2 bar gauge and 1.5 bar gauge; beer temperature (bottom 25%)<9° C.

The cartridge is preferably a disposable item, and can be supplied new with each keg that a consumer purchases. Ease of use and sanitation are advantages of this arrangement.

Figure 13:
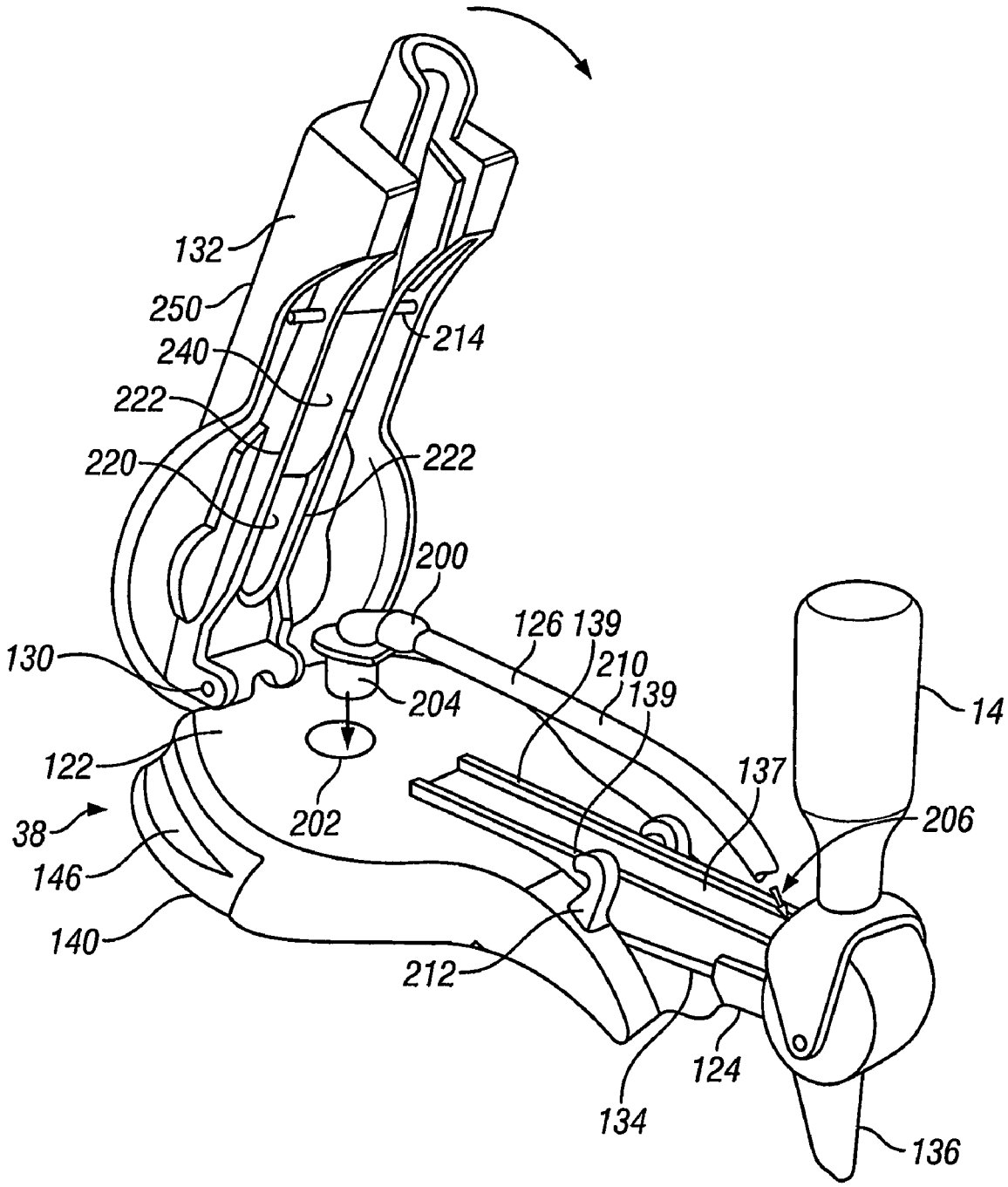
FIG. 13 is a perspective view of the tap adapter showing the hollow arm in an open position and the tube ready for insertion into the adapter.
Figure 17:
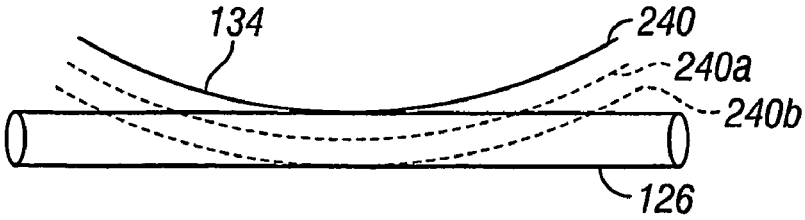

Turning now to a second embodiment of the present invention wherein a collapsible dispensing tube is used to provide a flow restriction—refer to FIGS. 13 and 17, where inserted into the lower guide channel 137 is an elongated dispensing tube 126. Referring to FIG. 13, the dispensing tube 126 defines a passageway through which beverage flows to be dispensed from the adapter 38. The dispensing tube 126 has a first end portion 200 comprising a 90 degree elbow connector that passes through aperture 202 in the lower arm portion 134 of the adapter 138. The connector 200 has a cylindrical port 204 which sealingly engages with valve 54. The dispensing tube 126 has a second end portion 206 which is passed into and through the tap 14 to communicate beverage out through the tap end or spout 136. The length of the dispensing tube 126 comprises a flexible walled material and is herein referred to as a flexible wall portion 210. In particular this flexible wall portion 210 is located between the end portions 200 and 206 of the tube 126. During assembly of the tube 126, the adapter connector 200 is inserted through aperture 202 and also the tube 126 is inserted into the lower guide channel 137 with the end 206 passing into the spout 136. Thereafter the upper arm portion 132 is pivoted about pivot point 130 downwardly into a closed position. Arms 132, 134 are locked in place by latches 212 on lower arm portion 134 which lock over fingers 214 found in the upper arm portion 132 of the adapter 38. The upper arm portion 132 is further provided with an upper elongated guide channel 220 that has side guide walls 222. As the upper arm portion 132 is closed on the lower arm portion 134 the upper elongated guide channel 220 passes over the tube 126 and locks the tube within the lower guide channel 137.

The upper guide channel 220 is provided with a flow restricting actuator 240. The actuator 240 comprises a wall protrusion protruding inwardly from the recessed guide channel 220 and positioned between the side walls 222. This wall protrusion or flow restricting actuator 240 is of fixed size and shape. Alternatively, protrusion 240 could pivot about the fingers 214 and have its movement controlled by adjusting screw (not shown) passing threadingly through the top face 250 of the upper arm portion 132 to push against wall protrusion 240 so as to control the extent that the protrusion 240 protrudes from the upper elongated guide channel 220.

Figure 14:
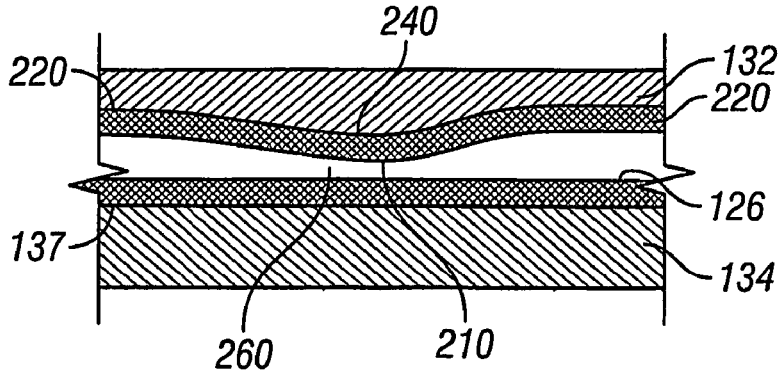
FIG. 14 is an elongated side sectional view showing partial collapsing of the dispensing tube.

FIG. 14 shows the effect on the tube 126 from closing the upper arm portion 132 on the lower arm portion 134. In particular, FIG. 14 shows a cross sectional view through the tube 126 where the protrusion 240 restricts the cross sectional diameter of the passageway in the tube 126. As shown in FIG. 14, the tube 126 rests on the recessed guide channel 137. The tube 126 is also supported by the upper recessed guide channel 220 and is partially collapsed by the flow restricting actuator 240 engaging the flexible wall portion 210 of the tube 126. This flow restriction in the tube 126 acts to counter any excessive pressure in the keg dispense apparatus. That is, pressure that is applied within the keg 22 (see FIG. 3) against the bag 44 to collapse the bag 44 and push beverage out through the spear 102, valve 54 and tube 126 to the spout 136. In FIG. 14, the collapsed portion 260 of the flexible tube 126, the flow aperture, is clearly reduced but subsequently increases slowly or gradually downstream from the restrictor toward end 206 and acts to counter any excessive pressure and thereby control the flow of beverage out through the spout 136. As a result, by restricting the flow of beverage, the beverage flows at a predetermined dispense flow rate chosen to reduce excessive or undesirable foaming of the beverage.

The adapter 38 is provided with a base portion 140 for supporting the hollow arm 120. The base portion 140 has a neck or supporting ring 142 that is adapted to surround and releasably engage the valve neck flange 49. The base portion 140 further includes an annular flange portion 144—see FIG. 9—which provides an inverse shape of a saucer that is adapted to abut the top surface of the keg 22 and to be supported thereon. The base portion 140 has locking spring members 146 (see FIG. 13) that engage the valve neck groove 47 and are movable to release the adapter 38 from the valve assembly 40. Tap 14 is connected to the remote end 124 of the hollow arm 120 and in particular the lower arm portion 134. The tap is operable between a closed position to shut off the flow of beverage through the hollow arm as shown in FIG. 6 and an open position permitting beverage to flow through the hollow arm and out the tap 14 as shown in FIG. 7. The tap 14 also forms an integral part of the hollow arm 120 and in particular the lower portion 134. The tap 14 has a handle 140 that is pivotally connected to a cam member 150 so as to rotate cam member 150 into pinching engagement against tube 126 as indicated at pinching point 152. The handle will be normally biased in this position and may be drawn forward to release cam member 150 from the tube 126 and thereby open the tube at point 152 and permit beverage to be dispensed along the tube 126 contained within the hollow arm 120 from the valve assembly 40.

Figure 15:
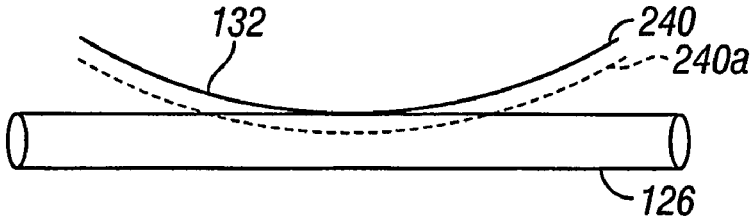
FIGS. 15 to 17 are further elongated side sectional views showing partial collapsing of the dispensing tube.
Figure 16:
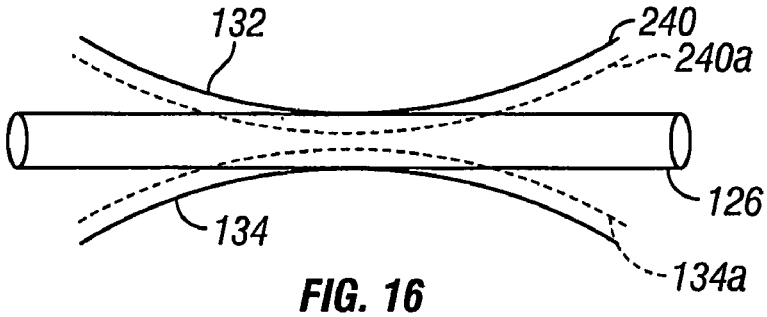

Referring to FIGS. 15 to 17 the dispensing tube 126 is shown collapsed in different manners. In FIG. 15 the protrusion 240 is moved from the solid line portion shown at 240 to the broken line portion at 240*a* to thereby partially collapse the dispensing tube 126. This partial collapse of the dispensing tube in FIG. 15 is similar to that shown in FIG. 14.

In FIG. 16, the dispensing tube 126 is shown collapsed from two opposing sides. In this embodiment the protrusion 240 and the lower arm portion 134 of the hollow arm 120 are brought into engagement at the same time with the dispensing tube 126. This results in the protrusion 240 in the lower arm portion 134 of the hollow arm 120 ending up in position 134*a*. It should be understood that the lower arm portion 134 may also be provided with its own protrusion to thereby partially collapse the dispensing tube 126. Because the upper arm portion 132 moves relative to the lower arm portion 134 in the preferred embodiment, the protrusion in the lower arm portion 134 begins to partially deflect or collapse the tube 126 as the upper arm portion 132 is closed upon the lower arm portion 134 and thereby brings the protrusion 240 into engagement with the dispensing tube 126.

In FIG. 17, the upper arm portion is selectively collapsible to bring protrusion 240 either into the position shown at 240*a* or the position shown at 240*b*. The first position shown at 240*a* is the partial collapse of the dispensing tube 126. This provides the requisite flow restriction which is the subject of the present invention. However, the upper arm portion 134 may be closed to bring the protrusion 240*a* into the position shown at 240*b* whereby the tube 126 is completely closed. This acts as a valve a close the tube to allow for the second end portion 124 of the dispensing adapter 38 and other component parts of the dispensing adapter 38 located downstream from the closure to be serviced and cleaned.

What is claimed is:

1. A conduit for conducting gasified liquid, said conduit having a flow restrictor arranged in in-line relation therewith, and said restrictor comprising an at least one aperture adapted to pass said gasified liquid flowing through said conduit and across a pressure drop from a higher-pressure upstream side of said aperture to a lower-pressure downstream side of said aperture, and wherein said aperture is operable to moderate a rate of change in pressure over a transitional pressure drop to mitigate a formation of localized pressures below a critical pressure at which off-gassing from a carbonated liquid results in substantial foam formation, and said conduit is a pliable tube, which is compressible in situ to form an aperture by the application of external force.

2. The conduit according to claim 1, comprising a plurality of apertures arranged in series along the path of the gasified liquid flow, and wherein sequential downstream pressure drops are produced between successive pairs of apertures to respective intermediate pressures that are lower than the pressure upstream of the first aperture in said series and higher than the pressure downstream of the last aperture in said series.

3. The conduit according to claim 2, wherein at least one of said apertures is venturi-shaped.

4. The conduit according to claim 2, wherein said apertures comprise at least two static apertures.

5. The conduit according to claim 1, wherein the aperture is shaped as a venturi.

6. The conduit according to claim 1, wherein the gasified liquid is selected from one of the group consisting of: a carbonated liquid; or a nitrogenated liquid; or a combination carbonated and nitrogenated liquid.

7. The conduit according to claim 1, comprising a liquid dispense conduit.

8. The conduit according to claim 3 or 5, wherein said liquid is a beverage.

9. The conduit according to claim 8, wherein said beverage is beer.

10. The conduit according to claim 3 or 5, wherein said venturi has a back angle of less than 24 degrees.

11. The conduit according to claim 10, wherein said back angle is about 20 degrees or less.

12. The conduit according to claim 11, wherein said back angle is about 15 degrees or less.

13. The conduit according to claim 3 or 5 which comprises a formed tube having an integral stricture arranged there along to form the venturi.

14. The conduit according to claim 1, wherein said application of external force is a clamping action.

15. The conduit according to claim 14, wherein said clamping action applies external force along a tube contacting face of a cam or wedge shaped body, to produce a correspondingly shaped aperture within said tube.

16. The conduit according to claim 1, in which inlet end and the outlet ends thereof are substantially the same internal diameter.

17. The conduit according to claim 16 wherein the inlet end is adapted to engage a keg valve.

18. The conduit according to claim 16 wherein the outlet end is a nozzle through which the beer is dispensed into a beverage container.

19. The conduit according to claim 1, comprising a flexible tubing that is compressed by a valve to constrict flow between substantially free flowing dispense and shutoff conditions.

20. The combination of a pre-formed tubular cartridge according to claim 13 and a tap adapter for use in dispensing an alcohol beverage from a keg having a self-contained bag filled with an alcohol beverage, the keg having a neck and a valve assembly mounted to the neck of the keg where the valve assembly has a first valve through which beverage is dispensed from the keg and one of the keg and valve assembly has a second valve through which pressurized air is fed into the keg against an outside wall of the bag; the tap adapter comprising: a hollow arm adapted for releasably mounting in sealed relation with the valve assembly in fluid flow communication with the first valve, the hollow arm having a first end portion and a second end portion remote therefrom, the first end portion adapted to connect to the first valve to open the valve, and wherein the hollow arm supports said insertable tubular cartridge comprising a tube through which the beverage flows; a tap connected to the remote end of the hollow arm, the tap being operable between a closed position shutting off flow of beverage through the tube supported within said hollow arm and an open position permitting beverage to flow through tube within the hollow arm and out the tap; an air line passageway adapted to be connected to the second valve in sealed fluid flow communication therewith, and a pump connected to the air line passageway for supplying pressurized air to the second valve.

21. The combination of claim 20 wherein the air line passageway has a first end portion that connects to and opens the second valve, and has a second end portion connected to the pump.

22. The combination of claim 20 wherein the air line passageway has an air valve adapted for connection to the pump.

23. The combination of claim 20 wherein the valve assembly has a valve neck portion that extends beyond the neck portion of the keg, and the adapter has a base portion for supporting the hollow arm, the base portion comprising a neck adapted to releasably engage the valve neck and an annular flange portion adapted to abut the keg.

24. The combination of claim 23 wherein the base portion has spring locking members that engage the valve neck and are movable to release the adapter from the valve assembly.

25. The combination of claim 20 wherein the tap has a cam member that rotates to close fluid flow through the hollow arm of the adapter.

26. The combination of claim 20 wherein the hollow arm is separable to receive a tubular cartridge for interconnecting the tap with the first valve and through which the beverage is dispensed.

27. The combination of claim 26 wherein the hollow arm is pivotally connected adjacent the first end portion to permit for separation of the hollow arm into an upper arm portion and a lower arm portion.

28. The combination of claim 27 wherein the lower arm portion is adapted to receive the cartridge in snap fit relation therewith.

29. The combination of claim 28 wherein the tap has a cam member that rotates to close fluid flow through the tubular arm by pinching the tube closed.

30. The combination of claim 20 wherein the pump is manually operated.

31. The combination of claim 20 wherein said venturi has a back angle of less than 24 degrees.

32. The tap adapter of claim 1 wherein said increase in diameter is such that the interior wall of the dispensing tube downstream of said collapsed flexible wall portion has an angle of not more than 24 degrees to the longitudinal axis of the tube.

33. A tap adapter for use in dispensing an alcohol beverage from a container, the tap adapter comprising:

a dispensing tube providing a beverage flow passageway for dispensing beverage from the container, and the dispensing tube having a flexible wall portion; and a flow restricting actuator adapted to engage the flexible wall portion of the dispensing tube to partially collapse the flexible wall portion and restrict flow of beverage along the beverage flow passageway, said beverage flow passageway downstream of flexible wall portion increasing in diameter and only gradually.

34. The tap adapter of claim 33 further comprising an arm member having an elongated guide channel and the dispensing tube extending along the elongated guide channel.

35. The tap adapter of claim 34 wherein the arm member supports the flow restricting actuator.

36. The tap adapter of claim 35 wherein the flow restriction actuator has a protrusion adapted to be brought into engagement with the flexible wall portion.

37. The tap adapter of claim 33 wherein the tap adapter has a tap with a cam member that rotates to pinch against the flexible wall portion to close the passageway.

38. The tap adapter of claim 35 wherein the protrusion extends inwardly from an internal wall of the arm member.

39. The tap adapter of claim 35 wherein the protrusion extends inwardly from and integrally of the elongated guide channel.

40. The tap adapter of claim 39 wherein the protrusion extends inwardly from the guide channel by a variable amount to control partial collapsing of the passageway and thereby control flow of beverage through the passageway.

41. The tap adapter of claim 33 wherein the flow restricting actuator variably engages the flexible wall portion to control the partial collapse of the flexible wall portion and thereby control flow restriction through the passageway.

42. The tap adapter of claim 33, further including a second flow restricting actuator adapted to engage the flexible wall portion.

43. The tap adapter of claim 33 wherein the flow restricting actuator is adapted to engage the flexible wall portion at a first position of engagement restricting flow of beverage along the beverage flow passageway and at a second position of engagement closing the flow passageway.

44. A tap adapter for use in dispensing an alcohol beverage from a keg containing the alcohol beverage, the keg having a neck and a valve assembly mounted to the neck of the keg, the valve assembly having a first valve through which the beverage is dispensed from the keg, the tap adapter comprising:

a hollow arm adapted for releasably mounting in sealed relation with the valve assembly;

a dispensing tube supported in the hollow arm, the dispensing tube having a passageway through which the beverage flows from the valve assembly, the passageway having a first end portion adapted for connection with the first valve for receiving the beverage, the passageway having a second end portion from which the beverage is dispensed, and the dispensing tube having a flexible wall portion intermediate of the first and second end portions;

a flow restricting actuator adapted to engage the flexible wall portion of the dispensing tube to partially collapse the flexible wall portion and restrict flow of the beverage through the passageway; and a tap connected to the hollow arm remotely of the valve assembly, the tap being operable between a closed position shutting off flow of the beverage through the passageway and an open position permitting the beverage to flow through the passageway and out the second end portion.

45. The tap adapter of claim 44 wherein the tap forms an integral part of the hollow arm of the adapter.

46. The tap adapter of claim 44 further comprising a base portion having spring locking members that engage the valve neck and are movable to release the adapter from the valve assembly.

47. The tap adapter of claim 44 wherein the tap has a cam member that rotates to pinch against the flexible wall portion to close the passageway.

48. The tap adapter of claim 44 wherein the hollow arm is separable into an upper arm portion and a lower arm portion movable between an open position for receiving the dispensing tube and a closed position for positively locating the dispensing tube in the hollow arm.

49. The tap adapter of claim 48 wherein:

the lower arm portion has an entry port for receiving the first end portion of the passageway in sealing relation with the first valve, and the lower arm portion has a lower elongated guide channel for receiving the dispensing tube; and the upper arm portion has an upper elongated guide channel that cooperates with the lower elongated guide channel to positively locate the dispensing tube in the hollow arm when the upper and lower arm are closed.

50. The tap adapter of claim 49 wherein the flow restricting actuator comprises a protrusion in at least one of the lower and upper elongated guide channels that is adapted to collapse the passageway upon closure of the upper and lower arms.

51. The tap adapter of claim 50 wherein the upper and lower guide channels each comprise channel walls and at least one of the channel walls carries said protrusion.

52. The tap adapter of claim 48 wherein the lower and upper arm portions are pivotally connected adjacent the first end portion of the dispensing tube.

53. The tap adapter of claim 52 wherein the tap is supported from the upper arm portion.

54. The tap adapter of claim 44 wherein the flow restricting actuator variably engages the flexible wall portion to control the partial collapse of the flexible wall portion and thereby control flow restriction through the passageway.

55. The tap adapter of claim 44, further including a second flow restricting actuator adapted to engage the flexible wall portion.

56. The tap adapter of claim 44 wherein the flow restricting actuator is adapted to engage the flexible wall portion at a first position of engagement restricting flow of beverage along the beverage flow passageway and at a second position of engagement closing the flow passageway.

* * * * *